US007755289B2

(12) United States Patent
Belliveau

(10) Patent No.: US 7,755,289 B2
(45) Date of Patent: Jul. 13, 2010

(54) TEMPERATURE REDUCTION FOR TOP PINCH OF ARC LAMP

(75) Inventor: Richard S. Belliveau, Austin, TX (US)

(73) Assignee: Barco Lighting Systems, Inc., Austin, TX (US)

( * ) Notice: Subject to any disclaimer, the term of this patent is extended or adjusted under 35 U.S.C. 154(b) by 764 days.

(21) Appl. No.: 11/731,973

(22) Filed: Apr. 2, 2007

(65) Prior Publication Data

US 2008/0238321 A1 Oct. 2, 2008

(51) Int. Cl.
*H01J 11/00* (2006.01)

(52) U.S. Cl. ..... 313/607; 313/234

(58) Field of Classification Search ..... 313/234, 313/607, 563

See application file for complete search history.

(56) References Cited

U.S. PATENT DOCUMENTS

| | | | | |
|---|---|---|---|---|
| 3,377,498 | A | 4/1968 | Koury et al. | 313/635 |
| 3,723,784 | A | 3/1973 | Sulcs et al. | 313/47 |
| 4,721,887 | A | 1/1988 | Inukai et al. | 313/623 |

*Primary Examiner*—Joseph L Williams
(74) *Attorney, Agent, or Firm*—Walter J. Tencza, Jr.

(57) ABSTRACT

An arc lamp apparatus is disclosed, which may include a base having a plurality of electrical connections, and a vessel. The vessel may include a plurality of electrodes, a gas filled bulb, and a plurality of pinches. An electrical arc that emits radiation may be formed within the plurality of electrodes. A first pinch may contain a first electrode of the plurality of electrodes. A second pinch may be fixed perpendicular to the base. The second pinch may contain a second electrode not fixed to the base. The second electrode may be connected to an external electrode connecting lead that routes in proximity to the gas filled bulb. The external electrode connecting lead may be shrouded by a reflective material.

20 Claims, 2 Drawing Sheets

TEMPERATURE REDUCTION FOR TOP PINCH OF ARC LAMP

FIELD OF THE INVENTION

This invention relates to arc lamps.

BACKGROUND OF THE INVENTION

Arc lamps are glass or quartz vessels that house electrodes that are used to produce an electrical arc for illumination purposes. The vessel is usually filled with a gas such as xenon or mercury. Sometimes various other elements are added to obtain an enhanced color temperature or the electrical arc such as sodium. The electrodes of the arc lamp are usually sealed by pinching the glass or quartz from the vessel around each electrode during a heat sealing process. The area where the electrodes have been sealed by the pinching process is commonly referred to as a "pinch".

It is important during operation of the arc lamp that each pinch not be allowed to rise above a certain temperature. Allowable temperatures for the pinch range from three hundred degrees centigrade to four hundred and fifty degrees centigrade. If the temperature of a lamp pinch is allowed to rise over the highest operating temperature the pinched area can start to oxidize rapidly in the area where the sealing of the electrode takes place. The oxidization of the pinch area at the electrode causes a catastrophic seal leak and can cause the vessel to leak out the filler gas sometime resulting in an explosion. U.S. Pat. No. 3,377,498 to Koury et al describes a high pressure arc lamp, and is incorporated by reference herein. U.S. Pat. No. 3,723,784 to Sulcs et. al. is incorporated by reference herein, and describes a high pressure sodium lamp with "heat reflecting shields surrounding its electrodes". Sulcs describes "Thus the seal temperature and the cold spot temperature can be controlled by adjusting the width of the foil". U.S. Pat. No. 4,721,887 to Inukai et al, incorporated by reference herein, describes a method of creating a pinched arc lamp seal.

It has been found that direct radiation and reflected radiation emitted from the arc created by the arc lamp can be absorbed by the external electrode connecting leads. It is desirable to reduce the absorbed radiation of the external electrode connecting leads in order to reduce the temperature of the lamp pinch.

SUMMARY OF THE INVENTION

A novel means of altering the absorbing properties of the external electrode connecting leads of an arc lamp is disclosed. The electrode leads may be coated with a light reflecting ceramic paste to reduce the absorption of light emitted by the arc.

DETAILED DESCRIPTION OF THE DRAWINGS

Figure 1:
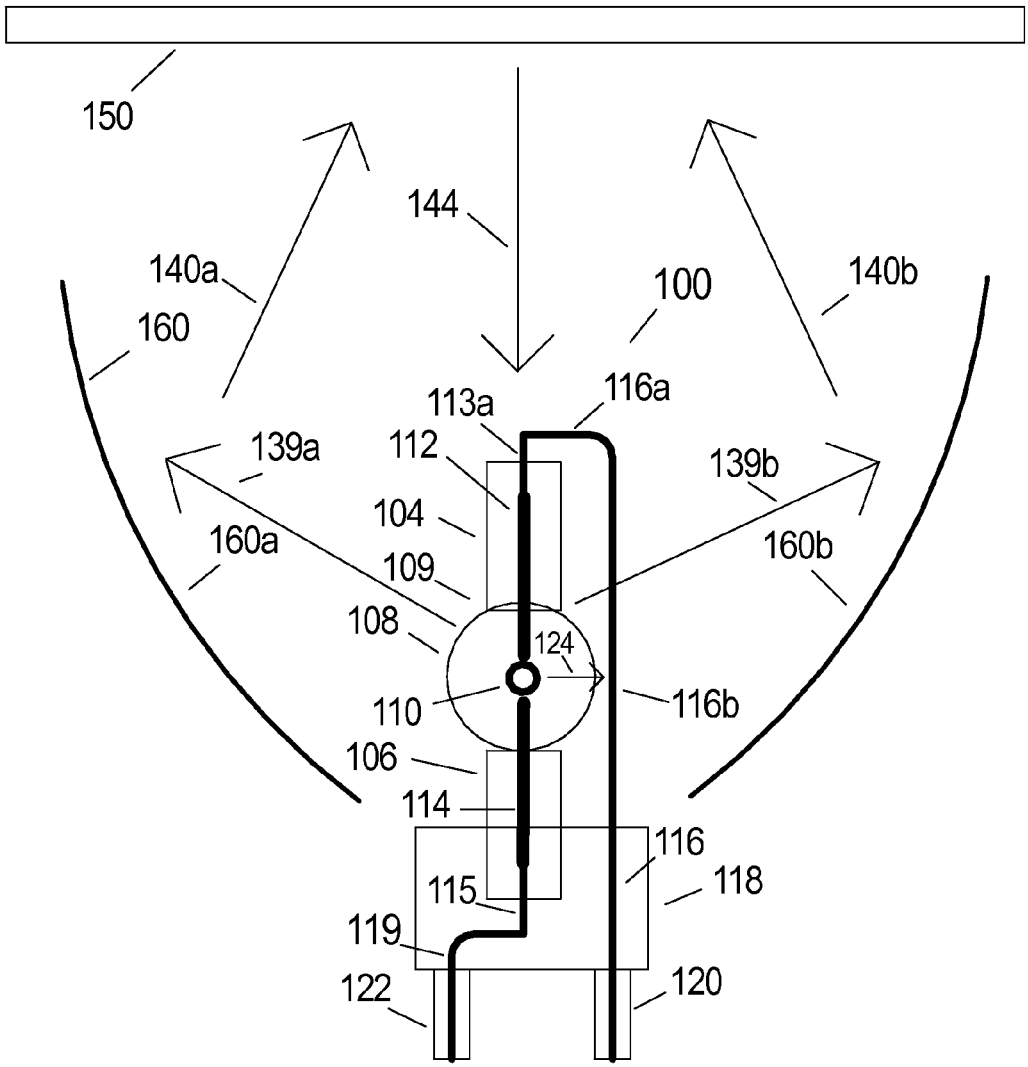
Prior Art FIG. 1
FIG. 1 shows a simplified diagram of a prior art arc lamp installed in a reflector with light created by the arc lamp being reflected by the reflector towards an optical component.

In the description that follows, like parts are marked throughout the specification and drawings with the same reference numerals, respectively. The drawing figures are not necessarily to scale. Certain features of embodiments of the present invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the present invention, and is not intended to limit the invention to that illustrated and described herein. It is to be fully recognized that the different teachings of the embodiments discussed below may be employed separately or in any suitable combination to produce the desired results.

FIG. 1 shows arc lamp 100 of the prior art mounted inside of a reflector 160 with the left half of the reflector shown as 160*a* and the right half of the reflector shown as 160*b*. Reflector 160 may be an ellipsoid or parabolic reflector as known in the art. The arc lamp 100 is constructed of a vessel 109 that may be of clear quartz material. The vessel 109 is comprised of a bulb or globe like structure 108, an upper pinch 104, and a lower pinch 106. The bulb 108 is filled with a gas such as mercury, xenon or other gases. The upper pinch 104 contains an upper electrode 112 connected to an upper external electrode connecting lead 113*a*. The upper external electrode connecting lead 113*a* connects to a top section 116*a* of an upper external electrode connecting lead 116 and connects to a power terminal pin 120. The lower pinch 106 contains a lower electrode 114 connected to a lower external electrode connecting lead 115. The lower external electrode connecting lead 115 connects to a lower external electrode connecting lead 119 and connects to a power terminal pin 122. A lamp base 118 houses the lamp vessel 109 by cementing the lower pinch 115 (cement not shown for simplification) perpendicular to the base 118 as known in the art. The lamp base 118 comprises the power terminal pin 122 that is connected to the lower external electrode connecting leads 115 and 119. The lamp base 118 also comprises the power terminal pin 120 that is connected to the upper external electrode connecting lead 116. Fixing one end of the lamp vessel 109 into the lamp base 118 and routing both upper external electrode connecting leads 116 and lower external electrode lead 115 to the lamp base 118 is also known as a single ended lamp as known in the art.

FIG. 1 shows an electrical arc 110 that emits radiation. The radiation may be comprised of visible, ultra violet and infrared radiation. Radiation from the arc 110 is emitted through the clear quartz wall of the bulb 108 in a predominantly spherical pattern as known in the art including the direction shown by arrow 124. The radiation directed in the direction of arrow 124 is cast upon the center section 116*b* of the upper external electrode connecting lead 116. The upper external electrode connecting lead 116 is commonly manufactured of tungsten or molybdenum but can be manufactured using a different conductive material. Tungsten or molybdenum are dark materials and thus can absorb visible and infrared radiation to a significant degree. The radiation directed in the direction of arrow 124 is thus absorbed by the center section 116*b* of the upper external electrode connecting lead 116 and causes a rise in the temperature of the upper external electrode connecting lead 116.

Radiation emitted from the arc 110 is also emitted in the direction of arrow 139*a* that reflects off of the left hand side of the reflector 160*a* in the direction of arrow 140*a*. Radiation emitted from the arc 110 is also emitted in the direction of arrow 139*b* that reflects off of the right hand side of the reflector 160*b* in the direction of arrow 140*b*. Often an optical device 150 such as a hot mirror that reflects infrared energy is placed in the path of the emitted radiation from the arc 110 as shown by arrows 140*a* and 140*b*. The optical device 150 could also be a lens, a protective window or an integrator as known in the art. The optical device 150 will often reflect some of the radiation that is collected by the reflector 160 from the arc lamp 100 in the direction of arrow 144. The radiation reflected off of the optical device 150 in the direction of arrow 144 casts itself upon the upper external electrode connecting lead 113*a* and the top section 116*a* of upper external electrode connecting lead 116 and thus raises the temperature of the upper external electrode connecting leads 113*a* and 116. The upper external electrode connecting lead 113*a* is often made from a metal such as tungsten or molybdenum or another metal that absorbs the radiation reflected from the optical device 150 in the direction of arrow 144. Absorption of the reflected radiation shown in the direction of arrow 114 by the upper external electrode connecting lead 113*a*, the top section 116*a* of the upper external electrode connecting lead 116 and absorption of the direct radiation shown in the direction of arrow 124 by the center section 116*b* of the upper external electrode connecting lead 116 raises the temperature of the upper external electrode connecting leads 113*a* and 116. When the temperature of the upper connecting leads 113*a* and 116 are raised the operating temperature of the pinch 104 also rises. This is an undesirable since management of the maximum pinch temperature of the pinch 104 is important for obtaining maximum life time of the arc lamp 100.

Figure 2:
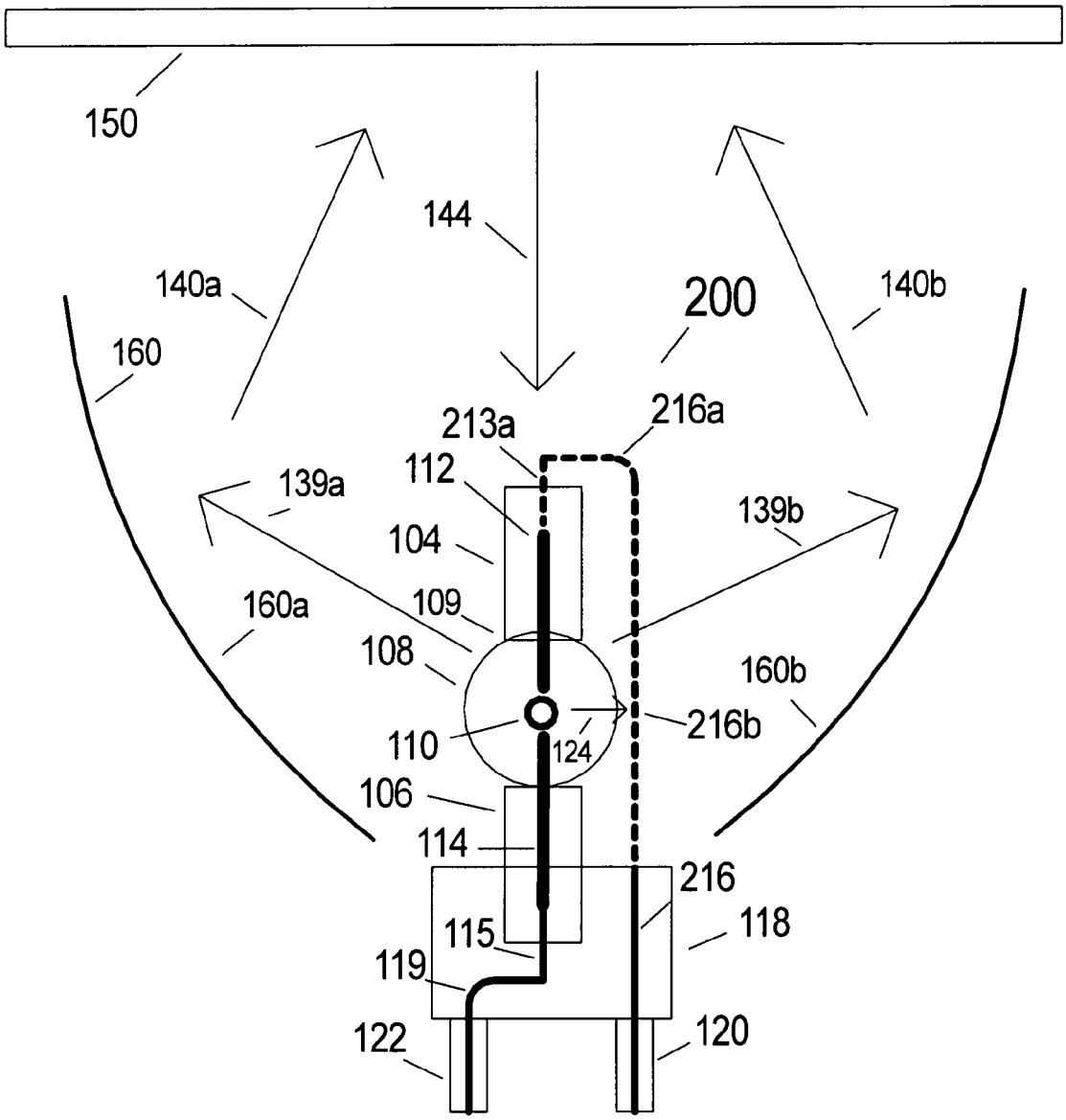
FIG. 2 shows a simplified diagram of an arc lamp of an embodiment of the present invention installed in the reflector with light created by the arc lamp being reflected by the reflector towards an optical component with reduced radiation absorption of the external electrode connecting leads.

FIG. 2 shows an arc lamp 200 of an embodiment of the present invention. In FIG. 2 all of the like numbered components are the same components of FIG. 1. However, the upper external electrode connecting leads 116 and 113*a* of FIG. 1 have been replaced by the upper external electrode connecting leads 216 and 213*a* in FIG. 2. The upper external electrode connecting lead 216 of FIG. 2 may a modified version of the upper external electrode connecting lead 116 of FIG. 1, wherein the top section 116*a* has been shrouded by a reflective material to form a modified top section 216*a* shown as a dashed line in FIG. 2, and the center section 116*b* has been shrouded by a reflective material to form a modified center section 216*b* shown as a dashed line in FIG. 2.

The reflective material used for upper external electrode connecting lead 213*a* and center portion 216*b* of external upper electrode lead 216 may be any material that can significantly reflect the radiation emitted in the direction of arrows 144 and 124. The center portion 216*b* is the portion of the upper external electrode connecting lead 216 that is shown routed in proximity to the bulb 108. The reflective shrouding of the modified center section shown as 216*b* of the upper external electrode connecting lead 216 reflects a large portion of the direct radiation in the direction of arrow 124 from the arc 110. In a preferred embodiment of the invention the reflective material used as a shroud is a ceramic paste that is bright white in color and can withstand a high temperature. The white ceramic paste is coated upon the upper external electrode connecting leads 113*a* and 116, shown in FIG. 1, to form upper external electrode connecting leads 213*a* and 216, shown in FIG. 2 wherever direct or reflected radiation from the arc 110 is cast upon the upper external electrode connecting leads (shown in FIG. 2 by a dotted line area of the upper external electrode connecting leads 213*a*, and sections 216*a*, and 216*b* of the upper external connecting lead 216. The white ceramic paste acts as a shroud and reflects a large portion of the radiation cast upon the upper external electrode connecting leads 213*a* and 216 thus reducing the temperature rise that the upper external electrode connecting leads 213*a* and 216 would normally conduct to the upper pinch 104. Reducing the absorption of upper external electrode connecting leads 213*a* and 216 can reduce the operating temperature of the upper pinch 104 by as much as 20 degrees centigrade. The reduction of 20 degrees centigrade at the upper pinch 104 can provide the necessary thermal headroom for improved operation of the arc lamp 200 or allow more power to be applied to the arc 110 and produce a higher output arc lamp 200 over the prior art 100.

The white ceramic paste is one method of reducing the absorption of the upper external electrode connecting leads 213*a* and 216. A white ceramic tube may also be used over the upper external electrode connecting leads 213*a* and 216 in the areas where direct and reflected radiation are present to reduce absorption of the direct and reflected radiation. Any radiation reflecting material that reflects the radiation created by the arc 110 may be applied to the upper external electrode connecting lead 113*a* and areas 116*a* and 116*b* or lead 116, to form lead 213*a*, and areas 216*a*, 216*b*, and lead 216. Alternatively the upper external electrode connecting leads 213*a* and 216 may be constructed of a conducting material that is also reflective to the energy emitted by the arc 110.

I claim:

1. An arc lamp apparatus comprising:

a base comprising a plurality of electrical connections;

a vessel comprising:

a plurality of electrodes, a gas filled bulb, and a plurality of pinches, wherein an electrical arc that emits radiation is formed within the plurality of electrodes;

wherein a first pinch of the plurality of pinches contains a first electrode of the plurality of electrodes;

wherein the first pinch is fixed perpendicular to the base;

wherein a second pinch of the plurality of pinches contains a second electrode of the plurality of electrodes not fixed to the base;

wherein the second electrode is connected to an external electrode connecting lead that routes in proximity to the gas filled bulb;

wherein the external electrode connecting lead is shrouded by a reflective material in an area where the external electrode connecting lead is routed in proximity to the gas filled bulb;

and wherein the external electrode connecting lead is located outside of the gas filled bulb, and outside of the first pinch and the second pinch.

2. The arc lamp apparatus of claim 1 wherein the reflective material is comprised of a ceramic.

3. The arc lamp apparatus of claim 2 wherein the ceramic is comprised of a ceramic tube placed over the external electrode connecting lead in proximity to the gas filled bulb.

4. An arc lamp apparatus comprising:

a base comprising a plurality of electrical connections;

a vessel comprising:

a plurality of electrodes, a gas filled bulb, and a plurality of pinches, wherein an electrical arc that emits radiation is formed within the plurality of electrodes;

wherein a first pinch of the plurality of pinches contains a first electrode of the plurality of electrodes;

wherein the first pinch is fixed perpendicular to the base;

wherein a second pinch of the plurality of pinches contains a second electrode of the plurality of electrodes not fixed to the base;

wherein the second electrode is connected to an external electrode connecting lead that routes in proximity to the gas filled bulb;

wherein the external electrode connecting lead is shrouded by a reflective material in an area where the external electrode connecting lead is routed in proximity to the gas filled bulb;

wherein the reflective material is comprised of a ceramic; and wherein the ceramic is white in color.

5. The arc lamp apparatus of claim 4 wherein the white ceramic is comprised of a paste that is coated upon the external electrode connecting lead in proximity to the gas filled bulb.

6. An arc lamp apparatus comprising:

a base comprising a plurality of electrical connections;

a vessel comprising:

a plurality of electrodes, a gas filled bulb, and a plurality of pinches;

wherein an electrical arc that emits radiation is formed within the plurality of electrodes;

wherein a first pinch of the plurality of pinches contains a first electrode of the plurality of electrodes;

wherein the first pinch is fixed perpendicular to the base;

wherein a second pinch of the plurality of pinches contains a second electrode of the plurality of electrodes not fixed to the base;

wherein the second electrode is connected to an external electrode connecting lead that routes in proximity to the gas filled bulb;

wherein the second pinch contains the second electrode not fixed to the base; and wherein the external electrode connecting lead is shrouded by a reflective material in the area where the external electrode connecting lead is routed in proximity to the second pinch;

and wherein the external electrode connecting lead is located outside of the gas filled bulb, and outside of the first pinch and the second pinch.

7. The arc lamp apparatus of claim 6 wherein the reflective material is ceramic.

8. The arc lamp apparatus of claim 7 wherein the ceramic is comprised of a ceramic tube placed over the external electrode connecting lead in proximity to the second pinch.

9. An arc lamp apparatus comprising:

a base comprising a plurality of electrical connections;

a vessel comprising:

a plurality of electrodes, a gas filled bulb, and a plurality of pinches;

wherein an electrical arc that emits radiation is formed within the plurality of electrodes;

wherein a first pinch of the plurality of pinches contains a first electrode of the plurality of electrodes;

wherein the first pinch is fixed perpendicular to the base;

wherein a second pinch of the plurality of pinches contains a second electrode of the plurality of electrodes not fixed to the base;

wherein the second electrode is connected to an external electrode connecting lead that routes in proximity to the gas filled bulb;

wherein the second pinch contains the second electrode not fixed to the base;

wherein the second electrode is connected to an external electrode connecting lead; and wherein the external electrode connecting lead is shrouded by a reflective material in the area where the external electrode connecting lead is routed in proximity to the second pinch;

wherein the reflective material is ceramic; and wherein the ceramic is white in color.

10. The arc lamp apparatus of claim 9 wherein the white ceramic is comprised of a paste that is coated upon the external electrode connecting lead in proximity to the second pinch.

11. A method comprising forming an electrical arc that emits radiation within a plurality of electrodes;

wherein a first pinch of a plurality of pinches contains a first electrode of the plurality of electrodes;

wherein the first pinch is fixed perpendicular to a base;

wherein a second pinch of the plurality of pinches contains a second electrode of the plurality of electrodes not fixed to the base;

wherein the second electrode is connected to an external electrode connecting lead that routes in proximity to a gas filled bulb;

wherein the external electrode connecting lead is shrouded by a reflective material in an area where the external electrode connecting lead is routed in proximity to the gas filled bulb;

and wherein the external electrode connecting lead is located outside of the gas filled bulb, and outside of the first pinch and the second pinch.

12. The method of claim 11 wherein the reflective material is comprised of a ceramic.

13. The method of claim 12 wherein the ceramic is comprised of a ceramic tube placed over the external electrode connecting lead in proximity to the gas filled bulb.

14. A method comprising forming an electrical arc that emits radiation within a plurality of electrodes;

wherein a first pinch of a plurality of pinches contains a first electrode of the plurality of electrodes;

wherein the first pinch is fixed perpendicular to a base;

wherein a second pinch of the plurality of pinches contains a second electrode of the plurality of electrodes not fixed to the base;

wherein the second electrode is connected to an external electrode connecting lead that routes in proximity to a gas filled bulb;

wherein the external electrode connecting lead is shrouded by a reflective material in an area where the external electrode connecting lead is routed in proximity to the gas filled bulb;

wherein the reflective material is comprised of a ceramic; and wherein the ceramic is white in color.

15. The method of claim 14 wherein the ceramic is comprised of a paste that is coated upon the external electrode connecting lead in proximity to the gas filled bulb.

16. A method comprising:

forming an electrical arc that emits radiation within a plurality of electrodes;

wherein a first pinch of a plurality of pinches contains a first electrode of the plurality of electrodes;

wherein the first pinch is fixed perpendicular to a base;

wherein a second pinch of the plurality of pinches contains a second electrode of the plurality of electrodes not fixed to the base;

wherein the second electrode is connected to an external electrode connecting lead that routes in proximity to a gas filled bulb;

wherein a second pinch contains the second electrode not fixed to the base;

wherein the external electrode connecting lead is shrouded by a reflective material in the area where the external electrode connecting lead is routed in proximity to the second pinch;

and wherein the external electrode connecting lead is located outside of the gas filled bulb, and outside of the first pinch and the second pinch.

17. The method of claim 16 wherein the reflective material is comprised of a ceramic.

18. The method of claim 17 wherein the ceramic is comprised of a ceramic tube placed over the external electrode connecting lead in proximity to the second pinch.

19. A method comprising:

forming an electrical arc that emits radiation within a plurality of electrodes;

wherein a first pinch of a plurality of pinches contains a first electrode of the plurality of electrodes;

wherein the first pinch is fixed perpendicular to a base;

wherein a second pinch of the plurality of pinches contains a second electrode of the plurality of electrodes not fixed to the base;

wherein the second electrode is connected to an external electrode connecting lead that routes in proximity to a gas filled bulb;

wherein a second pinch contains the second electrode not fixed to the base;

wherein the second electrode is connected to an external electrode connecting lead; and wherein the external electrode connecting lead is shrouded by a reflective material in the area where the external electrode connecting lead is routed in proximity to the second pinch;

wherein the reflective material is comprised of a ceramic; and wherein the ceramic is white in color.

20. The method of claim 19 wherein the ceramic is comprised of a paste that is coated upon the external electrode connecting lead in proximity to the second pinch.

* * * * *